US005181316A

United States Patent [19]

Pote et al.

[11] Patent Number: 5,181,316

[45] Date of Patent: Jan. 26, 1993

[54] METHOD FOR MAKING FLEXIBLE COAXIAL CABLE

[75] Inventors: William Pote, Glen Gardner; Roger Johansen, South Plainfield; Thomas Pote, Gladstone, all of N.J.

[73] Assignee: Flexco Microwave, Inc., Port Murray, N.Y.

[21] Appl. No.: 749,194

[22] Filed: Aug. 23, 1991

[51] Int. Cl.[5] ..... H01B 13/10

[52] U.S. Cl. ..... 29/828; 29/728; 156/54; 174/102 D; 174/106 D

[58] Field of Search ..... 29/828; 138/144, 173, 138/174; 174/106 D; 156/54

[56] References Cited

U.S. PATENT DOCUMENTS

| | | | |
|---|---|---|---|
| 2,459,877 | 1/1949 | Gillis | 156/54 X |
| 2,525,300 | 10/1950 | Jones | 29/728 X |
| 3,183,300 | 5/1965 | Jachimowicz et al. | 156/54 X |
| 3,245,139 | 4/1966 | Scolaro | 29/825 |
| 3,586,754 | 6/1971 | Meskell, Jr. | 174/106 D |
| 3,672,196 | 6/1972 | Levacher et al. | 29/728 X |
| 3,797,104 | 3/1974 | Pote | 174/102 D X |
| 3,824,330 | 7/1974 | Lang | 174/102 D |
| 4,514,971 | 5/1985 | Mizuo | 174/102 D X |
| 4,758,685 | 7/1988 | Pote et al. | 29/828 X |
| 4,778,543 | 10/1988 | Pan | 174/102 D X |

FOREIGN PATENT DOCUMENTS

| | | | |
|---|---|---|---|
| 1074840 | 10/1954 | France | 29/728 |
| 600446 | 12/1959 | Italy | 29/728 |

*Primary Examiner*—Carl J. Arbes
*Attorney, Agent, or Firm*—Bryan Cave

[57] ABSTRACT

An improved method of making a flexible coaxial cable (10) having a dielectric core (12) comprising an inner conductor (14) and a dielectric (16) surrounding the inner conductor (14), and a corrugated outer conductive sheath (18, 20) having a plurality of peaks (22) and valleys (24) of predetermined pitch, comprises the step of substantially simultaneously crimping solely the valleys (24) from at least three angularly spaced directions, such as three equiangularly spaced directions about the longitudinal axis (110) of the outer sheath (18, 20), by using angularly spaced crimping wheels (100, 102, 104) which float to follow the predetermined pitch of the corrugated sheath (18, 20) for embedding the valleys (24) in the dielectric (12, 16) so as to lock the dielectric (12, 16) to the sheath (18, 20) for providing electrical stability for the resultant coaxial cable (10). The depth of at least one of the crimping wheels (100) may be micrometer (108) adjusted with respect to the sheath longitudinal axis (110) for setting the depth of locking. The other crimping wheels (102, 104) may act as guides in conjunction with a guide slot (118) through which the sheath (18, 20) passes during crimping for controlling the degree of freedom of movement of the crimping wheels (100, 102, 104) and sheath (18, 20).

17 Claims, 5 Drawing Sheets

FIG.3A
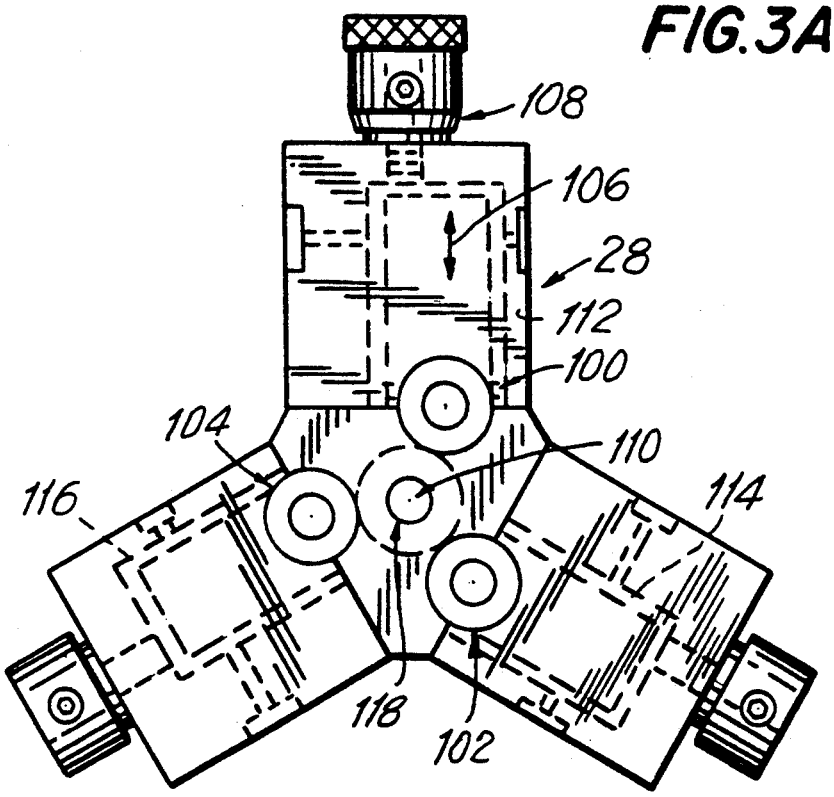
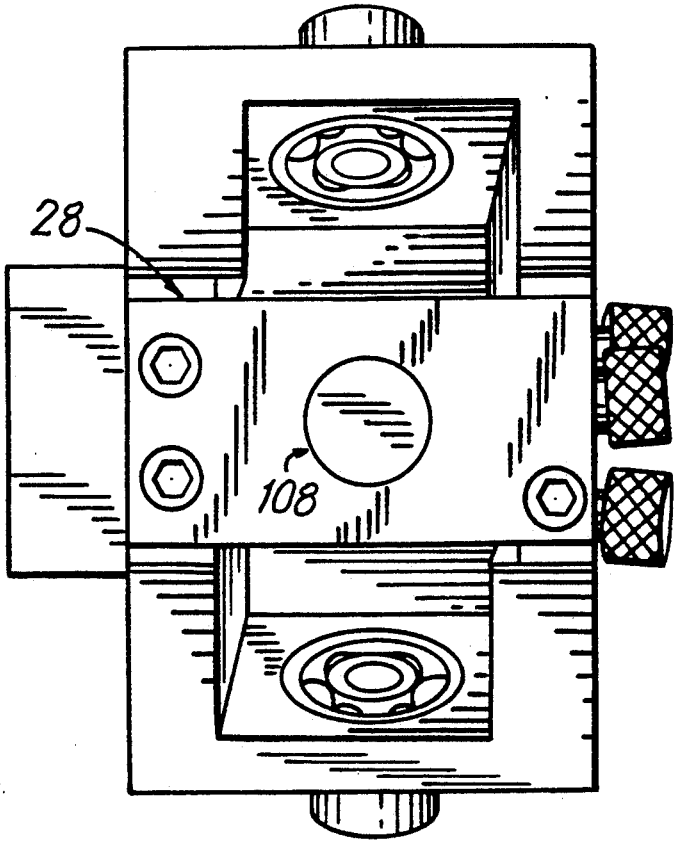
FIG.3B

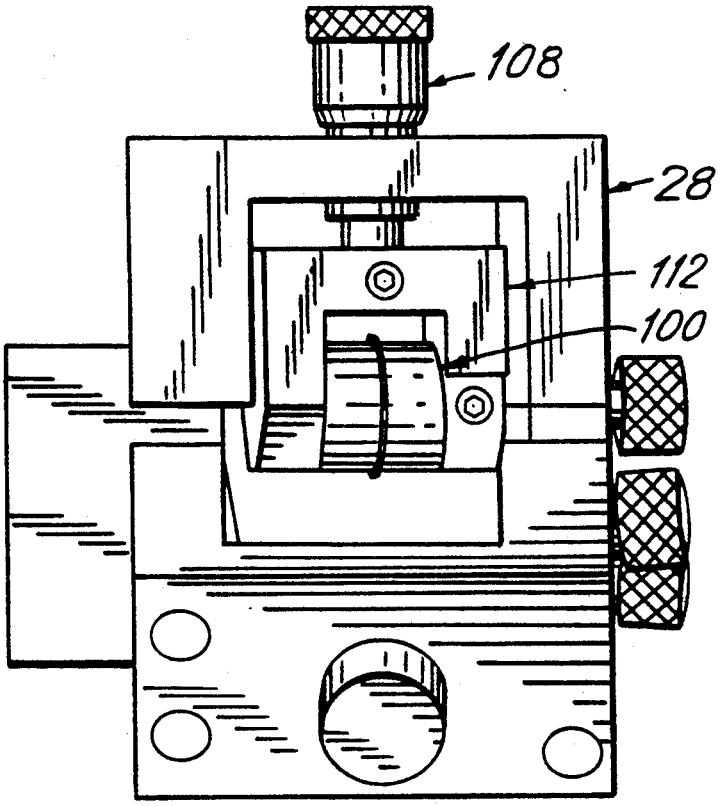
FIG.3C
FIG.5A
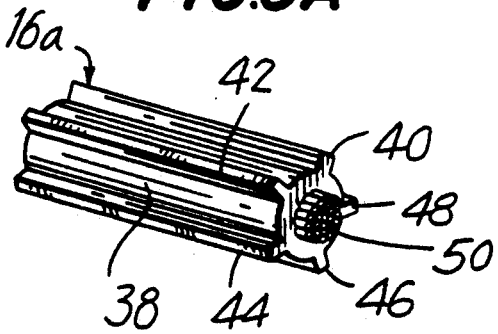
FIG.5B
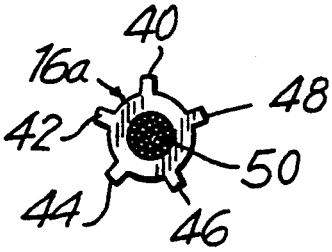

METHOD FOR MAKING FLEXIBLE COAXIAL CABLE

CROSS-REFERENCE TO RELATED APPLICATIONS

This application is related to commonly owned U.S. Pat. Nos. 3,797,104 and 4,758,685, both entitled "Flexible Coaxial Cable and Method of Making Same," naming William Pote as the sole inventor thereof, and is an improvement thereon. The contents of these patents are specifically incorporated by reference herein in their entirety.

TECHNICAL FIELD

The present invention relates to improvements in the methods of making flexible coaxial cables, and particularly to improvements in locking the outer conductive sheath of such cables to the interior dielectric core.

BACKGROUND ART

Coaxial cables, such as for microwave transmission have existed in the prior art for a considerable period of time. As technology has developed, a need for flexible coaxial cables whose electrical characteristics do not vary during flexure of the cable, such as in aerospace utilizations, has developed. In such utilizations, often the electrical characteristics of the cable are critical and any variation therein will yield unsatisfactory transmissions via such cables. In order to increase the flexibility of prior art coaxial cables, corrugated outer conductors, such as disclosed in U.S. Pat. Nos. 3,582,536; 3,173,990 and 2,890,263 have been utilized. In addition, other prior art attempts of providing such flexibility a corrugated outer sheath for the cable rather than a corrugated outer conductor, such as disclosed in U.S. Pat. No. 3,002,047. Furthermore, this concept of a corrugated outer sheath has been utilized for standard electrical cables as opposed to coaxial cables, where such cables are exposed to considerable flexure, such as disclosed in U.S. Pat. Nos. 2,348,641 and 2,995,616, In order to ensure electrical stability for a coaxial cable, the relative location between the various portions of the outer conductor, the dielectric and the inner conductor must remain constant during flexure of the cable or the electrical characteristics may vary. Prior art attempts to ensure this stability have involved the locking of a corrugated outer conductor to the dielectric surrounding the inner conductor, such as disclosed in U.S. Pat. No. 3,173,990 wherein such inner conductor is a foam polyethylene. However, such prior at flexible coaxial cables do not have sufficient flexibility nor do they have sufficient temperature stability, which also affects the electrical characteristics. These prior art coaxial cables utilize either a tube which is crimped to provide a corrugated tube or form- the outer conductor by means of helically winding a piece of conductive material, welding the adjacent pieces together to then form a tube and thereafter crimping alternate longitudinal portions so as to provide a corrugated tube. In both instances, the maximum pitch for the convolutions of the outer conductor is severely limited. In the first instance, this limitation is primarily due to rupture of the conductive tube if the crimps are too closely spaced together whereas, in the second instance, the limitations re primarily due to the inability to sufficiently control the thickness of the resultant tube which is formed as a thin enough material cannot be utilized to produce a high pitch. Since the higher the pitch of the convoluted outer conductor, the greater the flexibility of the coaxial cable, these prior art flexible coaxial cables have not been satisfactory where large degrees of flexure are required together with electrical and temperature stability over a wide range of flexure.

Furthermore, these prior art flexible coaxial cable have primarily been of the foam polyethylene or solid dielectric type whereas flexible coaxial cables utilizing spline dielectrics have not exhibited satisfactory electrical and temperature stability characteristics.

These disadvantages of the prior art have been overcome to an extent by the commonly owned prior inventions of U.S. Pat. Nos. 3,797,104 and 4,758,685, which employ mechanical crimping at a given fixed pitch to lock the outer conductive sheath to the dielectric core. However, if the outer conductive sheath does not have a consistent pitch or pitch angle prior to such mechanical crimping, then these slight variations of pitch and pitch angle on the sheath could result in problems of VSWR and attenuation when the resultant cable is used at higher frequencies. These disadvantages of the prior art are overcome by the improved method of the present invention which provides uniform crimping of the sheath to the dielectric core without having to change the pitch or pitch angle if these slight variations are present in the outer sheath prior to such crimping.

DISCLOSURE OF THE INVENTION

An improved method of making a flexible coaxial cable having a dielectric core comprising an inner conductor and a dielectric surrounding the inner conductor, and a corrugated outer conductive sheath having a plurality of peaks and valleys of predetermined pitch, comprises the step of substantially simultaneously crimping solely the valleys from at least three angularly spaced directions, such as three equiangularly spaced directions, such as substantially 120 degrees apart, about the longitudinal axis of the outer sheath by using angularly spaced crimping wheels which float to follow the predetermined pitch of the corrugated sheath for embedding the valleys in the dielectric so as to lock the dielectric to the sheath for providing electrical stability for the resultant coaxial cable. As a result, the innermost radial extent of the sheath defined by the valleys after crimping is less than the outermost radial extent of the core. The depth of at least one of the crimping wheels may be micrometer adjusted with respect to the sheath longitudinal axis for setting the depth of locking. The other crimping wheels may act as guides in conjunction with a guide slot through which the sheath passes during crimping for controlling the degree of freedom of movement of the crimping wheels and sheath. The characteristic impedance of the coaxial cable may be measured during crimping for stopping the crimping when a predetermined value of characteristic impedance is reached. The crimped cable may be temperature cycled for providing temperature stability in addition to the electrical stability resulting from locking.

BRIEF DESCRIPTION OF THE DRAWINGS

FIGS. 1–4 are diagrammatic illustrations of various steps in practicing the improved method of the present invention, with FIGS. 3A–3C illustrating, in various views an improved crimping mechanism for carrying out the improved method of the present invention, and with FIGS. 1, 2 and 4 being similar to FIGS. 1-3, respectively, of U.S. Pat. No. 3,797,104;

BEST MODE FOR CARRYING OUT THE INVENTION

Figure 1:
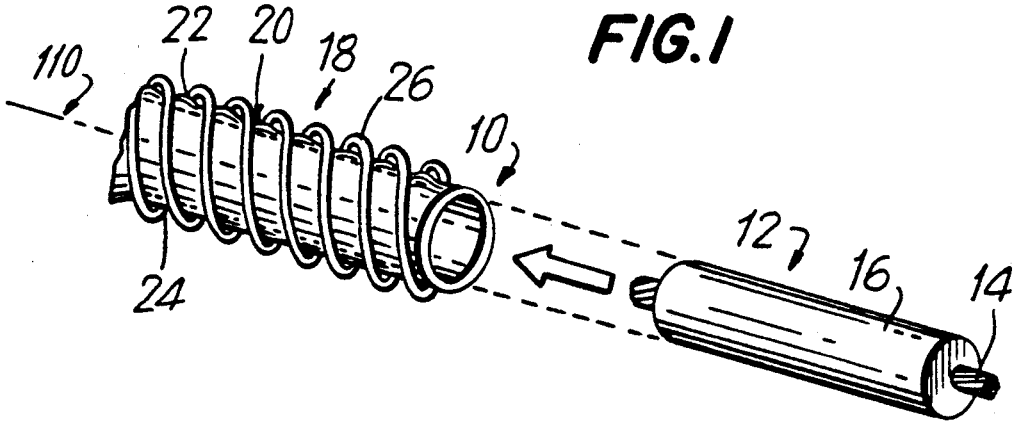
Figure 2:
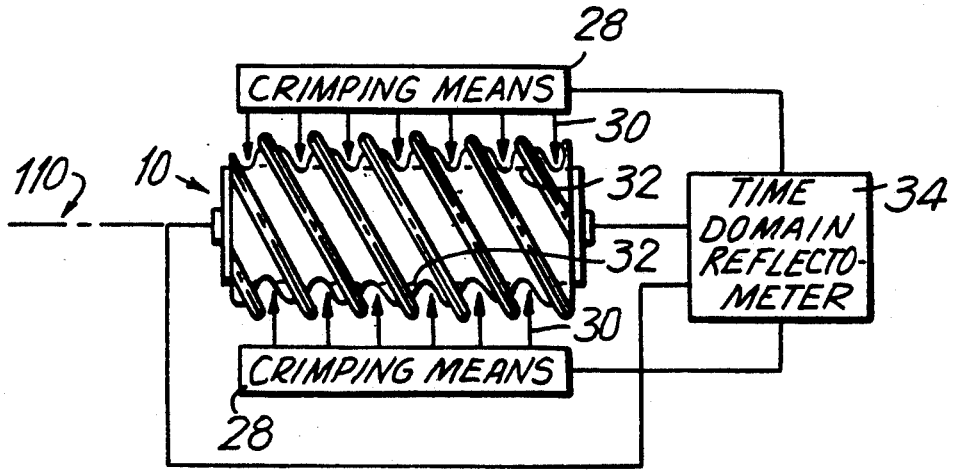
Figure 4:
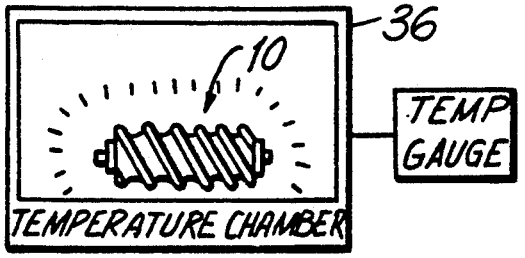

Referring now to the drawings in detail, and initially to FIGS. 1-4 and 7, the presently preferred improved method of the present invention for making a flexible coaxial cable, generally referred to by the reference numeral 10, shall be described.

Referring now to the drawings n detail and especially to FIGS. 1 through 3A-3C thereof, the preferred method of the present invention for making a flexible coaxial cable, generally referred to by the reference numeral 10, shall be described and, various flexible coaxial cable configurations which may be manufactured in accordance with this preferred method shall be described.

Figure 8:
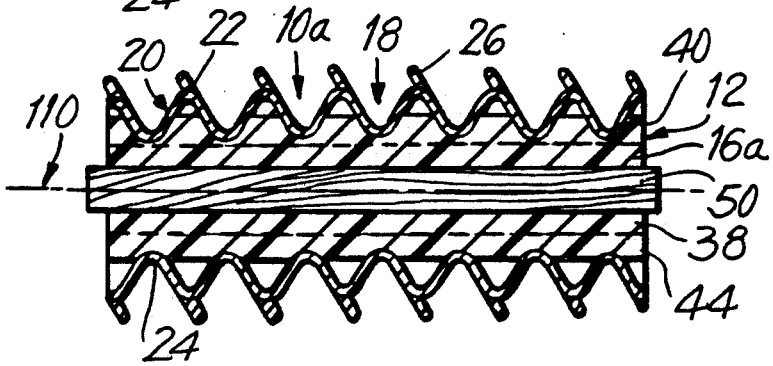
FIG. 8 is a cross-sectional view, similar to FIG. 7, of a flexible coaxial cable produced in accordance with the improved method of the present invention wherein a spline dielectric is used in place of the solid dielectric of FIG. 7, and is similar to FIG. 5C of U.S. Pat. No. 3,797,104.

In accomplishing the preferred method of the present invention, a core 12 is initially provided for the coaxial cable. The core 12 is preferably composed of an inner conductor 14 such as a solid copper center conductor illustrated in FIG. 1 or a braided conductor illustrated in FIG. 8, which is surrounded by a dielectric, such as Teflon, high density polyethylene or polyethylene form which is locked to the inner conductor 14 in conventional fashion such as by fusion. The configuration of the dielectric 16 may be foam, solid as illustrated by way of example in FIG. 1, or spline as illustrated in FIG. 8, or any other desired dielectric configuration. For purposes of explanation of the preferred method of the present invention, it shall be assumed that the configuration of the dielectric 16 is a solid dielectric as illustrated in FIG. 1. The core 12 which is readily available, is preferably cut to a length which is slightly longer than the desired end length of the resultant flexible coaxial cable 10. As shown in FIG. 1, an outer conductor 18 is also provided for the flexible coaxial cable 10. The outer conductor 18 preferably is composed of a corrugated man conducive member 20 which has been corrugated to product peaks 22 and valleys 24 in the conductive member 20 at a predetermined pitch. The corrugated outer conductor 18 may be unnecessarily formed as a single piece or may comprise a helically wound conductive strip 26 preferably composed of the same conductive material as the main conductive member 20 helically wound about the peaks 22 of the corrugated main conductive member 20. If a conductive strip 26 is employed, the conductive strip 26 is preferably secured to these peaks 22 such as by soldering so as to form a single unitary composite conductive member wherein the peaks 22 are accentuated by the helically wound strip 26 so as to increase the flexibility of the outer conductor 18. Such a strip wound outer conductor may preferably be of the type commercially available from Cooperative Industries of Chester, N.J. under the typical designations C8 of such a conductor having a 3/16ths inch nominal electrical outer diameter or H3 for such a conductor have a one quarter inch nominal electrical outer diameter, by way of example and not by way of limitation.

As will be explained in greater detail hereinafter, any desired pitch for the helically wound produced convolutions may be provided, the greater the pitch the greater the flexibility of the resultant flexible coaxial cable 10, the smaller the nominal size outer diameter for the outer conductor the greater the pitch, preferably. This outer conductor 18 is preferably also cut to the same desired length as that of the inner core 12. Most preferably, the initial outer diameter of the inner core 12 is slightly less than the inner diameter of the hollow outer conductor 18. The core 12 is inserted into the outer conductor 18 and aligned end to end. Thereafter, the composite cable containing the slidable inner core 12 and the outer conductor 18 is preferably crimped in the manner illustrated in FIG. 2, by way of example, by denting or crimping solely the valleys 24 existing between the peaks 22 associated with the convolutions of the strip wound conductor 26. Such crimping is preferably accomplished by angularly spaced wheels 100, 102, 104 which ride in the valleys 24, such as wheels which are one third the width of the valley 24, pressure being applied to these wheels so as to uniformly crimp the valleys throughout the longitudinal extent of the outer conductor 18. This is illustrated by crimping means 28 and arrows 30 in FIG. 2, and in more detail in FIG. 3 which shows a preferred crimping means 28 in accordance with the method of the present invention. The crimping is to an outer diameter less than the original outer diameter of the dielectric 16 of the core 12, this original outer diameter being illustrated in FIG. 2 by dotted line 32, so as to lock the dielectric 16 to the other conductor 18.

Preferably, the inner conductor of such a cable 10 is silver plated copper while the outer conductor is preferably a copper alloy.

Typically, by way of example the outer diameter of the dielectric 16 at the crimping points in the valleys 24 is varied between 15 and 20 mils where the core outer diameter is between 120 mils and 122 mils and the outer conductor 18 inner diameter is 125 mils and the outer conductor 18 inner diameter is 125 mils originally, such as for three sixteenths inch nominal outer diameter flexible coaxial cable. The mechanical crimping is preferably accomplished in accordance with the desired characteristic impedance of the resultant coaxial cable. In other words, the outer conductor is crimped, which varies the characteristic impedance of the cable 10, until the desired predetermined characteristic impedance, such as 50 ohms for conventional microwave transmission, is provided for the cable. In order to accomplish this, the characteristic impedance of the cable 10 throughout the crimping step is measured by conventional means such as a time domain reflectometer of the type manufactured by Hewlett Packard under Model No. 1415 and illustrated in FIG. 2 by reference numeral 34. When the desired characteristic impedance appears on the time domain reflectometer 34 then the crimping is stopped either manually or by conventional electrical or mechanical means. The crimped locked coaxial cable 10 is then preferably placed in a conventional temperature chamber 36 and is temperature cycled in a predetermined temperature range at the extremes thereof such as, by way of example, preferably between 100° centigrade and plus 225° centigrade for Teflon and minus 60° centigrade and plus 80° centigrade for high density polyethylene. Preferably, the cable 10 is cooled at a temperature of minus 100° centigrade (for Teflon) or minus 60° centigrade (for high density polyethylene) for approximately two hours and is then heated at a temperature of plus 225° centigrade (for Teflon) or plus 80° centigrade (for high density polyethylene) for also approximately the same period of time of 2 hours. This provides temperature stability for the coaxial cable 10.

As will be explained in greater detail hereinafter, if desired, such as for a Teflon Dielectric, the crimping step and temperature cycling step may be repeated to increase the mechanical and temperature stability of the resultant coaxial cable 10.

Figure 5:
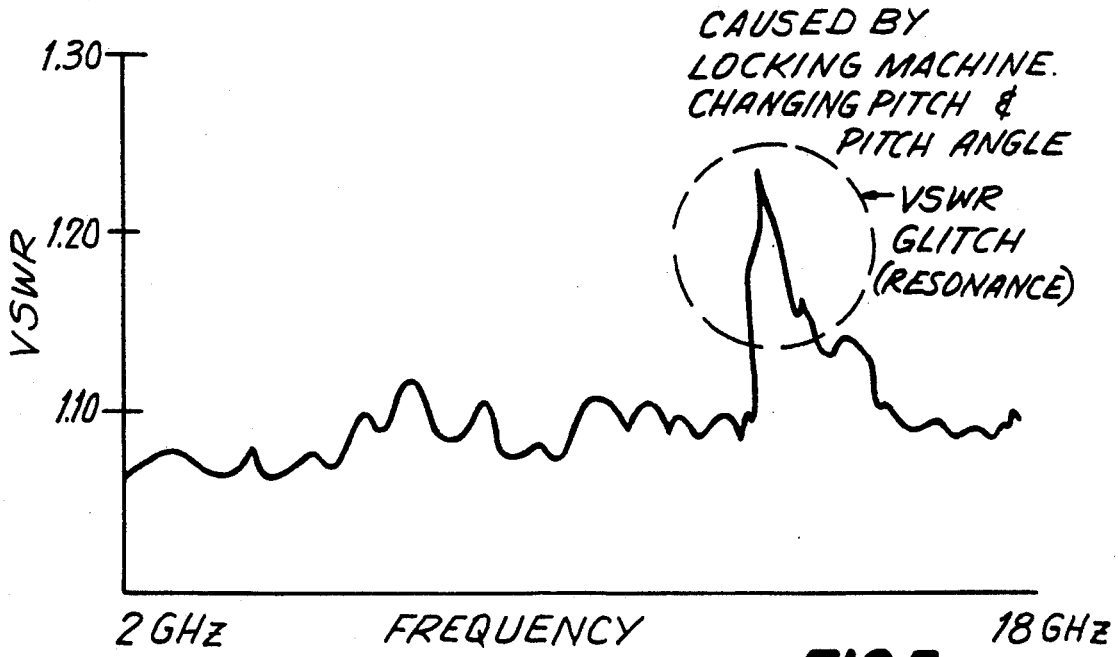
FIG.5 PRIOR ART
FIG. 5 is a graphical illustration of the effect on VSWR caused in the prior art by a change in pitch and pitch angle during locking.
Figure 6:
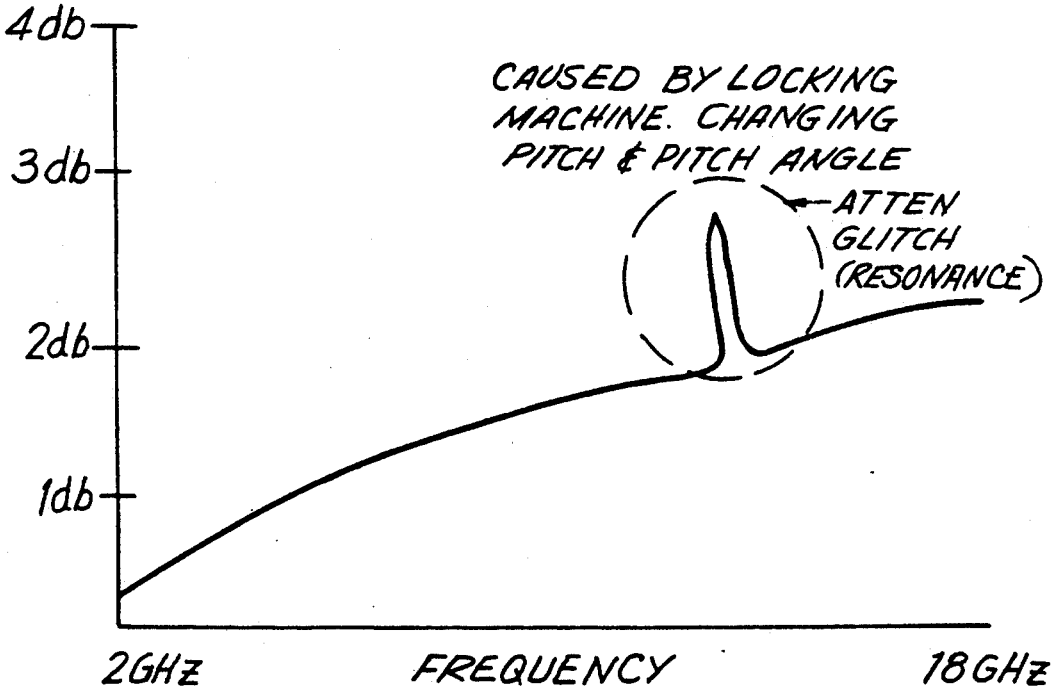
FIG.6 PRIOR ART
FIG. 6 is a graphical illustration, similar to FIG. 5, of the effect on attenuation caused in the prior art by a change in pitch and pitch angle during locking.
Figure 6A:
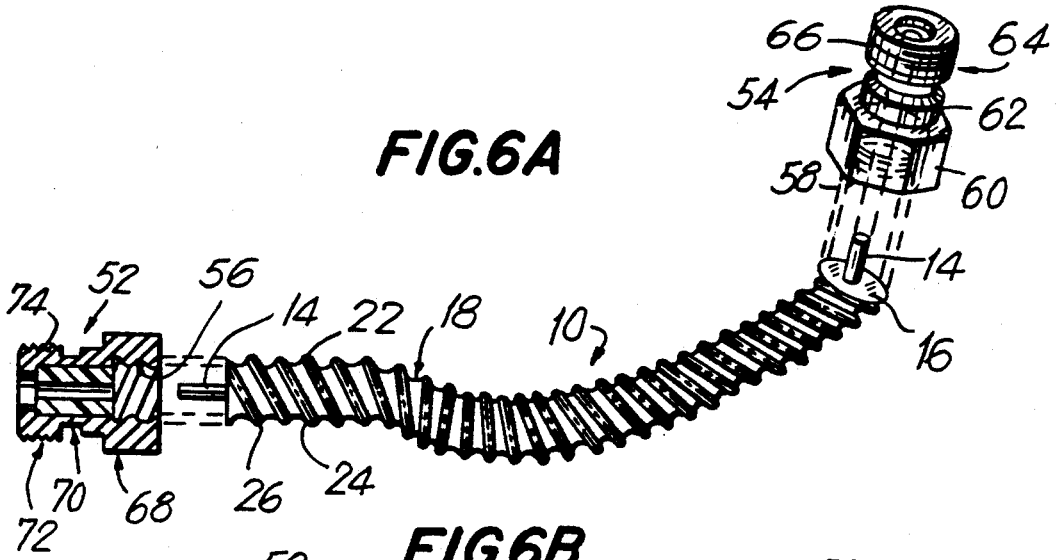
Figure 6B:
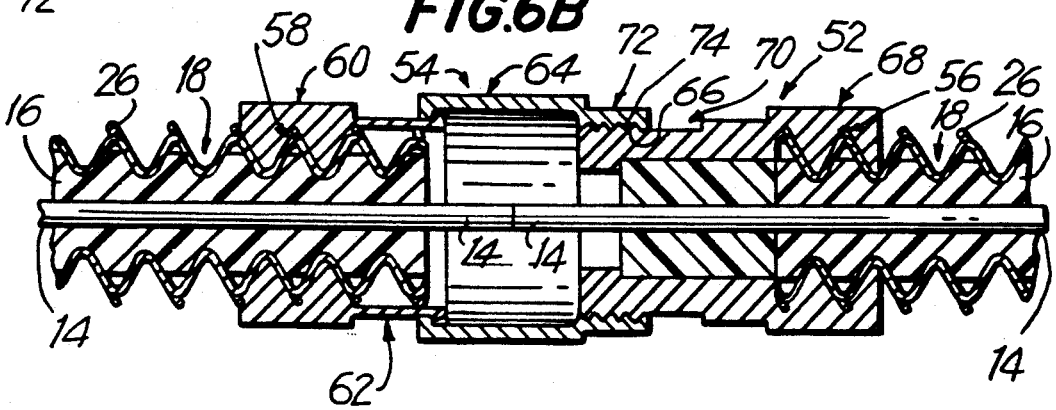

As shown and preferred in FIGS. 3A-3C, one of the angularly spaced wheels 100 is preferably adjustable in depth, in the direction of arrow 106 by means of a conventional micrometer adjustment 108 to move wheel 100 toward and away form the longitudinal axis 110 of the outer conductive sheath 18 so as to set the depth of locking of the sheath 18 to the dielectric core 12 so as to uniformly crimp the valleys 24 at this depth throughout the longitudinal extent of the outer conductor 18. All of the crimping wheels 100, 102, 104 are preferably mounted so as to float to follow the pitch of the outer conductive sheath 18, with such mounts being conventional floating mounts and illustrated in phantom by reference numerals 112, 114, 116, respectively, in FIGS. 3A-3C. As also shown and preferred in FIGS. 3A-3C, the crimping means 28 includes a longitudinal guide slot 118 through which the cable 10 is passed during crimping which controls the degree of freedom of movement of the cable 10 and the wheels 100, 102, 104. The other two crimping wheels 102, 104 preferably act as guides during crimping of the outer conductive sheath 18 to the dielectric core 12. This arrangement preferably enables uniform crimping of the sheath 18 to the core 12 without having to change the pitch or the pitch angle of the sheath, thereby eliminating any glitches in the VSWR or attenuation response at the higher frequencies, such as the glitches of the type illustrated in FIG. 5 for VSWR and in FIG. 6 for attenuation.

Figure 7:
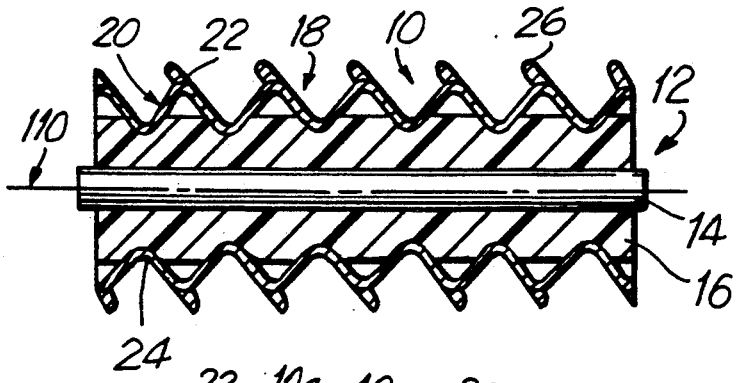
FIG. 7 is a cross-sectional view of a flexible coaxial cable produced in accordance with the improved method of the present invention, similar to FIG. 4 of U.S. Pat. No. 3,797,104.

Referring now to FIG. 7, a cross sectional view of a typical preferred coaxial cable produced in accordance with the Preferred method of the present invention is shown. By way of example and not limitation, the cable 10 illustrated in FIG. 7 has a solid dielectric 16 and a solid inner conductor 14. As was previously mentioned, the dielectric 16 may be any dielectric material such as Teflon or a polyolefin such as high density polyethylene or polyethylene foam and the inner conductor 124 may be any desired conductor material such as silver plated copper. As illustrated in FIG. 7, the outer conductor 18 is preferably composed of a hollow tubular corrugated main conductive member 20 comprising a plurality of uniformly spaced peaks 22 and valleys 24 having a predetermined pitch and a helically wound conductor strip, preferably composed of the same material as the tubular member 20, and being wound so as to be disposed about the peaks 22 of the corrugated inner member 20 so as to increase the depth of the corrugations. Most preferably, the helical strip 26 is secured to the peaks 22 of the tubular member 20 by conventional means such as soldering and is preferably of the conventional type commercially available such as manufactured by Cooperative Industries, of Chester, N.J., under typical designations such as C8 for three sixteenths inch nominal electrical outer diameter and H3 for one quarter inch nominal electrical outer diameter.

As also shown in FIG. 7, the valleys 24 of the outer conductor 18 are embedded into the dielectric 16 which prior to such embedding had a uniform radial dimension about its longitudinal extent, as illustrated in FIG. 1. The embedded valleys 24 lock the dielectric 16 to the outer conductor 18 so that the radial dimensions of the inner and outer conductors 14 and 18 are fixed during flexing of the resultant coaxial cable 10 so that the electrical parameters associated therewith do not vary during such flexure. The outer conductor 18 as well as the strip wound conductor 26 are preferably composed of a conventional conductor material such as copper alloy.

Referring now to FIG. 8, which is similar to FIG. 7, a typical preferred coaxial cable 10*a* having a core composed of a spline 16*a* dielectric and a braided inner conductor 50 is shown which coaxial cable 10*a* has been produced in accordance with the preferred method of the present invention. The outer conductor 18 is preferably identical with that previously described with reference to FIG. 7 and identical reference numerals associated with identical parts previously described with reference to FIG. 7 are utilized in FIG. 8 and will not be described in greater detail hereinafter. Suffice it to say that the primary difference between the coaxial cable 10 illustrated in FIG. 8 and the coaxial cable 10 illustrated in FIG. 7 is that the valleys 24 of the outer conductor are preferably only embedded in the surrounding fins 40 through 48 inclusive of the dielectric 16*a*. only fin 40 and a portion of fin 44 being visible in the view of FIG. 8. Thus, preferably, the valleys 24 are not embedded in the inner tubular portion 38 of the dielectric 16*a* of core 12 but rather only in the surrounding fins 40 through 48.

By utilizing the improved method of the present invention, uniform mechanical crimping of the outer conductive sheath to the inner dielectric core may readily occur even though slight variations may be present in the pitch or pitch angle along the outer conductive sheath prior to such crimping thereby improving the response of the resultant flexible coaxial cable at higher frequencies, such as in VSWR and attenuation.

It is to be understood that the above described embodiments of the invention are merely illustrative of the principles thereof and that numerous modifications and embodiments of the invention may be derived within the spirit and scope thereof.

What is claimed is:

1. In a method of making a flexible coaxial cable comprising the steps of providing a core for said cable, said core comprising an inner conductive member and dielectric means surrounding said inner conductive member, said inner conductive member being located substantially along the longitudinal axis of said dielectric means, said dielectric means having an outermost radial extent about said longitudinal axis; and providing a flexible hollow outer conductive sheath of substantially the same extent as said core, said sheath having a longitudinal axis coextensive with said core longitudinal axis and an innermost radial extent about said longitudinal axis which defines the innermost circumference of said hollow within said sheath, said sheath innermost radial extent being initially larger than said core outermost radial extent, said sheath comprising a corrugated portion having a plurality of peaks and valleys of predetermined pitch with a conductive portion disposed about said peaks, said valleys defining said sheath innermost radial extent, said peak conductive portion defining the sheath outermost radial extent; the improvement comprising the steps of inserting said core within said sheath until said sheath and said core are substantially coextensive; and substantially simultaneously crimping solely said valleys of said outer conductive sheath corrugated portion from at least three angularly spaced directions about said outer conductive sheath longitudinal axis by using angularly spaced crimping wheels which float to follow said predetermined pitch of said outer conductive sheath corrugated portion for embedding said valleys of said outer conductive sheath corrugated portion in said dielectric means so as to lock said dielectric means to said outer conductive sheath, said sheath innermost radial extent defined by said valleys after said crimping being less than said core outermost radial extent; whereby uniform crimping of said outer conductive sheath is provided for providing electrical stability for said flexible coaxial cable.

2. An improved method in accordance with claim 1 wherein said crimping step further comprises the step of adjusting the depth of at least one of said angularly spaced crimping wheels with respect to said sheath longitudinal axis for setting the depth of said locking of sheath to said dielectric means.

3. An improved method in accordance with claim 2 wherein said adjusting step further comprises the step of micrometer adjusting said depth of said one angularly spaced crimping wheel.

4. An improved method in accordance with claim 3 wherein said crimping step further comprises the step of controlling the degree of freedom of movement of said crimping wheels and said sheath during crimping, said controlling step comprising the step of passing said sheath through a guide slot during said crimping.

5. An improved method in accordance with claim 4 wherein said crimping step further comprises the step of guiding said sheath during crimping with at least a portion of said crimping wheels.

6. An improved method in accordance with claim 5 wherein said method further comprises the step of measuring the characteristic impedance of said coaxial cable during said crimping for stopping said crimping when a predetermined value of said characteristic impedance is reached.

7. An improved method in accordance with claim 6 wherein said method further comprises the step of temperature cycling said crimped coaxial cable between at least a pair of predetermined temperature extremes for a predetermined period of time at each of said extremes; whereby temperature stability is provided for said flexible cable.

8. An improved method in accordance with claim 1 wherein said method further comprises the step of measuring the characteristic impedance of said coaxial cable during said crimping for stopping said crimping when a predetermined value of said characteristic impedance is reached.

9. An improved method in accordance with claim 8 wherein said method further comprises the step of temperature cycling said crimped coaxial cable between at least a pair of predetermined temperature extremes for a predetermined period of time at each of said extremes; whereby temperature stability is provided for said flexible cable.

10. An improved method in accordance with claim 1 wherein said method further comprises the step of temperature cycling said crimped coaxial cable between at least a pair of predetermined temperature extremes for a predetermined period of time at each of said extremes; whereby temperature stability is provided for said flexible cable.

11. An improved method in accordance with claim 1 wherein said crimping step further comprises the step of controlling the degree of freedom of movement of said crimping wheels and said sheath during crimping, said controlling step comprising the step of passing said sheath through a guide slot during said crimping.

12. An improved method in accordance with claim 11 wherein said crimping step further comprises the step of guiding said sheath during crimping with at least a portion of said crimping wheels.

13. An improved method in accordance with claim 1 wherein said crimping step further comprises the step of guiding said sheath during crimping with at least a portion of said crimping wheels.

14. An improved method in accordance with claim 2 wherein said crimping step further comprises the step of controlling the degree of freedom of movement of said crimping wheels and said sheath during crimping, said controlling step comprising the step of passing said sheath through a guide slot during said crimping.

15. An improved method in accordance with claim 14 wherein said crimping step further comprises the step of guiding said sheath during crimping with at least a portion of said crimping wheels.

16. An improved method in accordance with claim 2 wherein said crimping step further comprises the step of guiding said sheath during crimping with at least a portion of said crimping wheels.

17. An improved method in accordance with claim 1 wherein said crimping step further comprises the step of crimping solely said valleys of said outer conductive sheath corrugated portion from at least three equiangularly spaced directions.

* * * * *